US007528808B2

(12) United States Patent
Tam

(10) Patent No.: US 7,528,808 B2
(45) Date of Patent: May 5, 2009

(54) PIXEL CIRCUIT

(75) Inventor: Simon Tam, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 692 days.

(21) Appl. No.: 11/067,669

(22) Filed: Feb. 28, 2005

(65) Prior Publication Data

US 2005/0237281 A1 Oct. 27, 2005

(30) Foreign Application Priority Data

Mar. 4, 2004 (GB) ..... 0404919.3

(51) Int. Cl.
*G09G 3/30* (2006.01)

(52) U.S. Cl. ..... 345/76; 345/82

(58) Field of Classification Search ..... 345/55–111
See application file for complete search history.

(56) References Cited

U.S. PATENT DOCUMENTS

2004/0201581 A1 10/2004 Miyazawa

FOREIGN PATENT DOCUMENTS

| | | | |
|---|---|---|---|
| EP | 0 905 673 | A1 | 3/1999 |
| EP | 1 170 719 | A1 | 1/2002 |
| EP | 1 220 191 | A3 | 7/2002 |
| JP | A 2004-007572 | | 1/2004 |
| JP | A 2004-070074 | | 3/2004 |
| JP | A 2004-126524 | | 4/2004 |
| JP | A 2004-145280 | | 5/2004 |
| WO | WO 03/077229 | A1 | 9/2003 |

OTHER PUBLICATIONS

Akira Yumoto et al., "Pixel-Driving Methods for Large-Sized Poly-Si AM-OLED Displays" Asia Display, IDW'01 Proceedings of the 21st International Display Research Conference in Conjuction with the 8th International Display Workshops, pp. 1395-1398, Oct. 16, 2001.

S.M. Choi et al., "A Self-compensated Voltage Programming Pixel Structure for Active-Matrix Organic Light Emitting Diodes" IDW. Proceedings of the International Display Workshops, pp. 535-538, 2003.

*Primary Examiner*—Richard Hjerpe
*Assistant Examiner*—Michael Pervan
(74) *Attorney, Agent, or Firm*—Oliff & Berridge, PLC

(57) ABSTRACT

It is known to compensate for threshold voltage variation of driving transistors in pixel circuits that drive light emission devices such as current driven organic light emission devices. However, programming and initialization of such pixel circuits can be slow and require a plurality of control or signal lines. The present invention provides a pixel circuit comprising an n-channel transistor for diode-connecting the driver transistor and a means for reducing the number of signal and control lines.

10 Claims, 15 Drawing Sheets

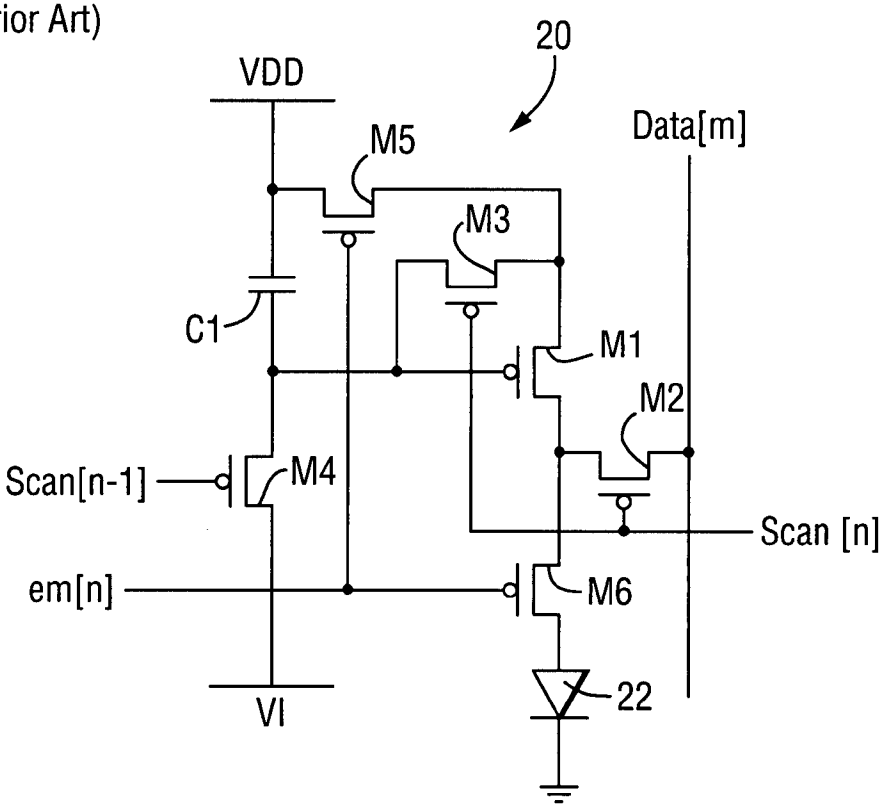
Fig.2.
(Prior Art)
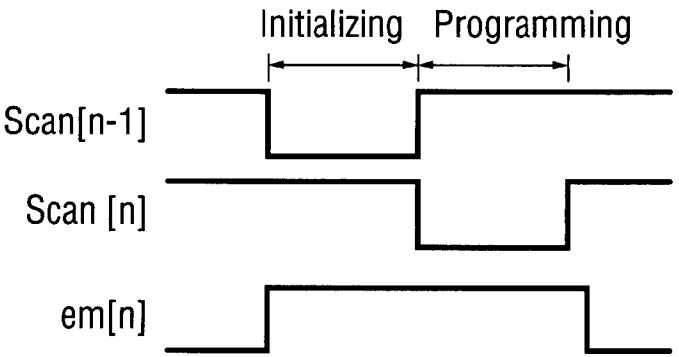
"A self-compensated voltage programming pixel structure for active-matrix organic light emitting diodes," by S.M. Choi, et. al., International Display Workshop 2003, Pp.535-538 (2003)

PIXEL CIRCUIT

BACKGROUND OF THE INVENTION

1. Field of the Invention

The present invention relates, in general, to a pixel circuit of a type employed in a display system using a current driven organic or other light-emission device as a light source.

2. Description of the Prior Art

Display systems commonly comprise an array of pixel circuits having an organic light-emitting device (OLED) as a light source and a driving circuit for driving the OLED in accordance with a received data signal. The OLED consists of a light-emitting polymer (LEP) layer sandwiched between an anode layer and a cathode layer. Electrically, the OLED operates as a diode whilst optically, the OLED emits light when forward biased with the brightness of the emitted light increasing as the forward bias current increases. By integrating the driving circuits of individual pixel circuits in the array using low-temperature polysilicon Thin Film Transistor (TFT) technology, it is possible to control the brightness of each individual OLED in order to provide a still or a moving image on the display.

Since an OLED is a current driven device, if the pixel circuit receives a voltage signal, a driver transistor or the like is required to supply an appropriate level of current to the OLED in response to the received voltage signal. An example of a known voltage driven pixel circuit for an active matrix OLED display is illustrated in FIG. 1. Referring to FIG. 1, a pixel circuit 10 comprises a first p-channel TFT $T_1$ and a second p-channel TFT $T_2$ per pixel. The first TFT $T_1$ is a switch for addressing the pixel circuit 10 and comprises a terminal coupled to a first supply line 12 for receiving a voltage data signal VData. The first TFT $T_1$ also comprises a gate terminal coupled to a second supply line 14 for receiving a supply voltage VSEL, and a terminal coupled to a gate terminal of the second TFT $T_2$. The second TFT $T_2$ comprises a terminal coupled to a third supply line 16 for receiving a supply voltage VDD, and a terminal coupled to an anode terminal of an OLED 18, a cathode terminal of the OLED 18 being coupled to ground. The second TFT $T_2$ is an analogue driver TFT for converting the voltage data signal VData into a current signal that in turn drives the OLED 18 at a designated brightness.

Display systems employing an array of voltage driven pixel circuits as illustrated in FIG. 1 can experience non-uniformity problems in their displayed images even though individual driving TFTs in the array are supplied with an identical voltage data signal and supply voltage. The non-uniformity arises due to a spatial variation in the threshold voltage of individual driving TFTs within the array of pixel circuits that form the display. Each OLED is therefore driven at a different brightness corresponding to the difference in threshold voltage between the driving TFTs. One approach to solving the non-uniformity problem has been disclosed by S. M. Choi, et al. in "A self-compensated voltage programming pixel structure for active-matrix organic light emitting diodes", International Display Workshop 2003, p535-538. A pixel circuit embodiment as disclosed by Choi et al., is illustrated in FIG. 2.

Referring to FIG. 2, a pixel circuit 20 for compensating voltage threshold variations of individual driving TFTs comprises six TFTs M1, M2, M3, M4, M5 and M6, one capacitor C1 and two horizontal control lines, scan[n−1] and scan[n]. M2, M3, M4, M5 and M6 are switching TFTs, and M1 is an analogue driver TFT for providing a current that in turn drives an OLED 22 at a designated brightness during a time period of one frame.

In operation, the fourth TFT M4 provides a current path to establish a gate terminal voltage of the driver TFT M1 at a predetermined value. The capacitor C1 is a storage capacitor and stores the gate terminal voltage of the driver TFT M1. Since the pixel circuit 20 requires two row line time to complete data programming operation, the scan[n] (present row scan) and the scan[n−1] (previous row scan) signals are applied to program the pixel circuit 20.

During the previous row scan, when the scan[n−1] signal is logic low, a gate terminal voltage of the driver TFT M1 is charged to a voltage VI in a step referred to as initialisation. Next and during the present row scan, when the scan[n] signal is logic low, TFT M2 and TFT M3 are turned on so that the voltage data signal data[m] is programmed to a gate node of the driver TFT M1 through diode connected driver TFT M1. At this time, the programmed voltage at the gate node of the driver TFT M1 is automatically reduced to a value data signal voltage data[m] less a threshold voltage $V_{TH}$ of the driver TFT M1. During initialisation and programming TFTs M5 and M6 are turned off.

Following the previous and present row scans, TFT M5 and TFT M6 are turned on by an em[n] signal to establish a current path from VDD to ground so that current can flow through the driver TFT M1 and drive the OLED 22. The driver TFT M1 therefore moderates the current independently of the voltage threshold $V_{TH}$.

Although the above pixel circuit 20 provides a means for compensating voltage threshold variations of individual driving TFTs, there is a need to increase the speed at which a pixel circuit can be programmed because an increase in programming speed is necessary in order that display systems can perform adequately when supplied with high bandwidth data or when employed in large size displays. Furthermore, there is a need for smaller display systems featuring lower power consumption in order to prolong the life of the power supply and expand the functionality of the system.

SUMMARY OF THE INVENTION

According to an aspect of the present invention, there is provided a pixel circuit comprising:

- a first transistor and a capacitor connected in series between a power supply line and a reference line, a gate terminal of the first transistor arranged to receive a first control signal;
- a driving transistor and a light emitting device connected in series between the power supply line and a further line, the driving transistor having a gate terminal connected to a first node, which is between the first transistor and the capacitor, and a first terminal for receiving a data signal; and
- a second transistor arranged to diode-connect the driving transistor in response to a second control signal received at a gate terminal of the second transistor, whereby the data signal can be passed through the driving transistor when diode-connected and held at the first node, the second transistor being an n-channel type transistor.

Preferably, a third transistor is connected in series between the power supply line and the driving transistor and a fourth transistor is connected in series between the light emitting device and the driving transistor, wherein one terminal of the second transistor is coupled to a second terminal of the driving transistor at a second node between the driving transistor and the third transistor.

Preferably, the third and fourth transistors are p-channel type transistors and their gate terminals are arranged to receive the second control signal. More preferably, a fifth transistor is connected between a data signal line and a third node between the driving transistor and the fourth transistor. The fifth transistor may be of an n-channel type transistor and comprise a gate terminal to receive the second control signal.

Preferably, a sixth transistor is coupled in series between the fourth transistor and the light emitting device, the sixth transistor being of the opposite channel type to the first transistor and having a gate terminal to receive the first control signal.

Preferably, a seventh transistor is coupled in series between the gate terminal of the driving transistor and the first node and an eighth transistor is coupled between the power supply line and a fourth node between one terminal of the seventh transistor and the gate terminal of the driving transistor, wherein the eighth transistor is of the same channel type as the first transistor and the seventh transistor is of the opposite channel type to the first transistor, the gate terminals of the seventh and eighth transistors being arranged to receive the first control signal.

The pixel circuit may further comprise a ninth transistor coupled between the first node and the terminal of the second transistor that is connected to the gate terminal of the driving transistor and a tenth transistor coupled between the first node and the other terminal of the second transistor that is connected to a second terminal of the driving transistor, wherein the ninth transistor is a p-channel type transistor and the tenth transistor is an n-channel type transistor and the gate terminals of the ninth and tenth transistors are arranged to receive the first and second control signals respectively.

According to another aspect of the present invention, there is provided a pixel circuit for driving a current driven element, comprising:

a first transistor of which a conduction state corresponds to a current level of a driving current that is supplied to the current driven element, the first transistor having a first gate terminal, a first terminal, and a second terminal;

a second transistor having a second gate terminal; and a third transistor arranged to control electrical connection between the first gate terminal and one of the first terminal and the second terminal, the third transistor having a third gate terminal, the first terminal arranged to receive a data signal through the second transistor, the data signal determining the conduction state of the first transistor, and a conduction type of the first transistor being different from a conduction type of the second transistor.

According to another aspect of the present invention, there is provided a pixel circuit for driving a current driven element, comprising:

a first transistor of which a conduction state corresponds to a current level of a driving current that is supplied to the current driven element, the first transistor having a first gate terminal, a first terminal, and a second terminal;

a second transistor having a second gate terminal; and a third transistor arranged to control electrical connection between the first gate terminal and one of the first terminal and the second terminal, the third transistor having a third gate terminal;

the first terminal arranged to receive a data signal through the second transistor, the data signal determining the conduction state of the first transistor, and a conduction type of the first transistor being different from a conduction type of the third transistor.

Preferably, a fourth transistor having a fourth gate terminal is coupled in series between the current driven element and the first transistor. More preferably, a conduction type of the fourth transistor is different from a conduction type of the second transistor.

Preferably, a fifth transistor having a fifth gate terminal is coupled in series between the first transistor and a power supply line from which the driving current is supplied to the current driven element through the first transistor.

A conduction type of the fourth transistor may be the same as a conduction type of the fifth transistor. The conduction type of the first transistor may be of a p-channel type. Preferably, the fourth gate terminal, the second gate terminal and the third gate terminal are connected to one signal line. Preferably, the fifth gate terminal, the second gate terminal and the third gate terminal are connected to one signal line. Preferably, a sixth transistor is coupled in series between the fourth transistor and the current driven element.

Preferably, the first gate is connected to a power supply line through a capacitor. More preferably, a seventh transistor is connected between the first gate and the first capacitor.

Preferably, an eighth transistor is connected directly between the power supply line and the first gate.

Preferably, a ninth transistor is connected between the capacitor and the second terminal.

According to another aspect of the present invention, there is provided a display apparatus comprising a plurality of pixel circuits as described above. Preferably, the display apparatus is formed with at least a first signal line, a second signal line, a third signal line and a data signal line in a matrix, the first control signal line providing a first control signal for a first pixel circuit and the second control signal line providing a second control signal for the first pixel circuit; wherein a first control signal for a second pixel circuit is the second control signal for the first pixel circuit provided by the second control line, and the third control line provides a second control signal for the second pixel circuit.

According to another aspect of the present invention, there is provided a method of driving a pixel circuit comprising:

applying a first control signal to switch on a first transistor connected between a power supply line and a reference line and in series with a first capacitor;

applying a second control signal to switch on a second transistor to diode-connect a driving transistor, the second transistor being an n-channel transistor and the driving transistor being connected in series to a light emitting device between the power supply line and a further line, a gate terminal of the driving transistor being connected to a first node between the first transistor and the first capacitor and a first terminal of the driving transistor arranged to receive a data signal;

applying the first control signal to switch off the first transistor;

applying the data signal to the first terminal of the driving transistor;

applying the second control signal to switch off the second transistor.

Preferably, the method further comprises applying the second control signal to a third transistor connected in series between the power supply and the driving transistor and to a fourth transistor connected in series between the light emitting device and the driving transistor to switch off the third and fourth transistors whilst the second transistor is switched on, and switch on the third and fourth transistors whilst the second transistor is switched off, wherein one terminal of the second transistor is coupled to one terminal of the driving transistor at a second node between the driving transistor and the third transistor.

Preferably, the third and fourth transistors are p-channel type transistors. Preferably, the method also comprises applying the second control signal to a fifth transistor connected between a data signal line and a third node between the driving transistor and the fourth transistor to switch on the fifth transistor whilst the second transistor is switched on and switch off the fifth transistor whilst the second transistor is switched off.

Preferably, the method further comprises applying the first control signal to a sixth transistor coupled in series between the fourth transistor and the light emitting device, to switch off the sixth transistor whilst the first transistor is switched on, the sixth transistor being of the opposite channel type to the first transistor.

Preferably, the method also includes applying the first control signal to a seventh transistor coupled in series between the gate terminal of the driving transistor and the first node and to an eighth transistor coupled between the power supply line and a fourth node between one terminal of the seventh transistor and the gate terminal of the driving transistor, wherein the eighth transistor is of the same channel type as the first transistor and the seventh transistor is of the opposite channel type to the first transistor, to switch off the seventh transistor and to switch on the eighth transistor whilst the first transistor is switched on.

Preferably, the method further comprises applying the first control signal to a ninth transistor connected between the first node and the terminal of the second transistor that is connected to the gate terminal of the driving transistor and applying the second control signal to a tenth transistor coupled between the first node and the other terminal of the second transistor that is connected to a second terminal of the driving transistor, wherein the ninth transistor is a p-channel type transistor and the tenth transistor is an n-channel type transistor, to switch off the ninth transistor when the first transistor is switched on and to switch on the tenth transistor when the second transistor is switched on.

The reference line may be a data signal line, or, wherein the first transistor is connected in series between the fifth transistor and the capacitor, the data signal line is the reference line, the method further comprising:

after applying the first control signal to switch on the first transistor and before applying the first control signal to switch off the first transistor, applying a pre-charge signal on the data signal line, the pre-charge signal having a value lower than the data signal.

According to another aspect of the present invention, there is provided a method of driving a pixel circuit that includes a first transistor having a first gate terminal, a first terminal and a second terminal, a second transistor having a second gate terminal, a third transistor that has a third gate terminal and that controls electrical connection between the first gate terminal and the second terminal, a fourth terminal that controls electrical connection between a current driven element and the first transistor, and a fifth terminal that controls electrical connection between the second terminal and a predetermined voltage, the method comprising:

producing a first state of the pixel circuit in which the second terminal being set to a predetermined voltage by turning on the fifth transistor;

producing a second state of the pixel circuit in which the first terminal is electrically connected to the second terminal through the third transistor at least a part of a first period during which the first terminal receives a data signal through the second transistor; and producing a third state of the pixel circuit in which a driving current of which a current level corresponds to a conduction state set through the second state is supplied to a current driven element through the first transistor and the fourth transistor, the second terminal being electrically disconnected from the predetermined voltage in the second state, the first terminal being electrically disconnected from the current driven element in the second state, and one control signal being supplied to the second gate terminal, the third terminal, the fourth terminal, and the fifth terminal in common.

When in use, the time taken for initialisation and programming of the pixel circuit according to the present invention is reduced thereby providing a more efficient, faster and more versatile display system than in the prior art. The third signal em[n] used in the prior art is no longer required since the arrangement of the pixel circuit permits signals em[n] and scan[n] to be replaced by a single control signal. In a preferred embodiment, a reference signal supply line is no longer required thereby providing a more compact display system. The number of control lines can also be reduced thereby also providing a more compact and efficient display system than is known from the prior art.

BRIEF DESCRIPTION OF THE DRAWINGS

Embodiments of the present invention will now be described by way of further example only and with reference to the accompanying drawings, in which:

FIG. 2 is a schematic diagram of a prior art self-compensated voltage programming pixel structure for an active-matrix OLED display;

DETAILED DESCRIPTION

Figure 1:
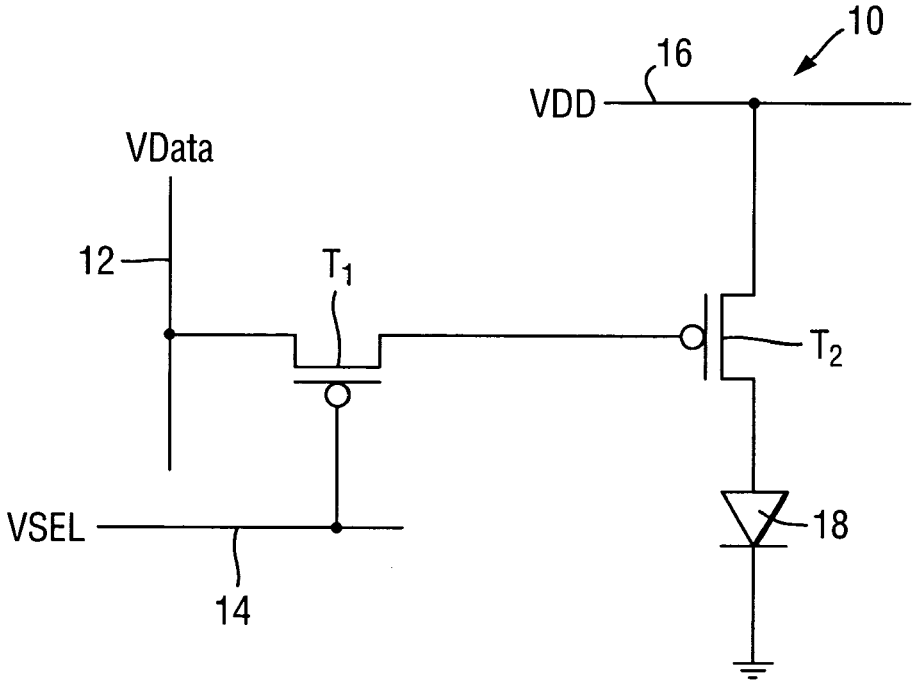
Fig.1. (Prior Art)
FIG. 1 is a schematic diagram of a prior art voltage driven pixel circuit for an active matrix OLED display.

Throughout the following description like reference numerals shall be used to identify like parts.

Figure 3:
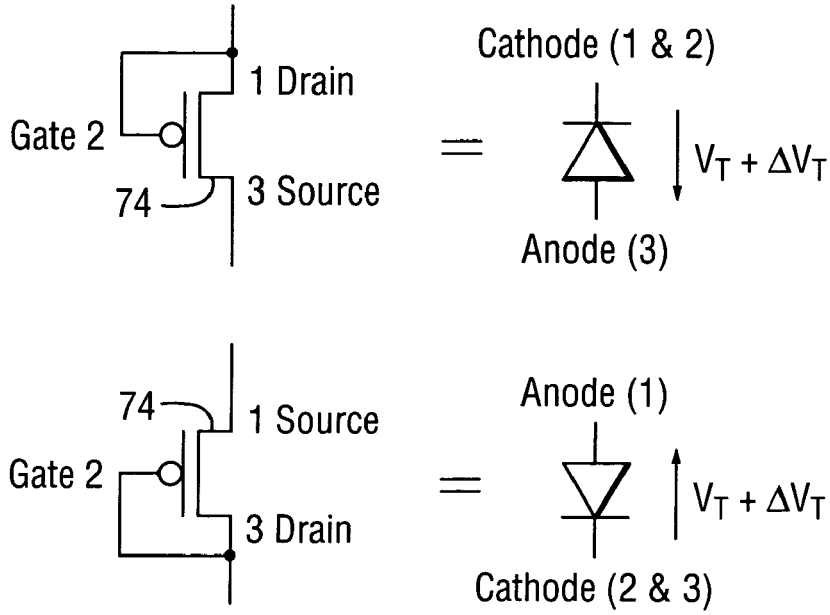
FIG. 3 is a schematic diagram illustrating two ways to diode connect a transistor.

Referring to FIG. 3, a driver transistor 74 having pins 1, 2, 3 can be diode-connected in two ways although in either configuration of a diode-connected transistor, a gate terminal is always connected to a drain terminal. Pins 1 and 2 can be connected thereby forming a cathode terminal with pin 3 forming an anode terminal. Alternatively, pins 2 and 3 can be connected thereby forming a cathode terminal with pin 1 forming an anode terminal.

As noted above, similar TFTs have varying threshold voltages even when they are manufactured at the same time and by the same process. All TFTs in an array can be considered to have a common nominal threshold voltage $V_T$. In addition, individual TFTs can be considered to have different threshold voltage variations $\Delta V_T$. Thus, the actual threshold voltage for each TFT is $V_T+\Delta V_T$, with $\Delta V_T$ varying between TFTs.

In the present invention, driver transistors have the property that the threshold voltage $V_T+\Delta V_T$ is the same irrespective of the direction in which current flows—in other words, which terminal is set as the source and which terminal is set as the drain.

Driver transistors that are symmetrical between the source and the drain terminal and which have not been stressed have this property. In symmetrical transistors, the source and drain terminal are equally doped and are symmetrical with respect to the gate terminal. Such transistors are commonly self-aligned. For a symmetrical driver transistor 74 with a nominal threshold voltage $V_T$ and a threshold voltage variation $\Delta V_T$, the observed threshold voltage of the driver transistor 74 when diode connected remains $V_T+\Delta V_T$ and is independent of the way the driver transistor 74 is diode connected.

Figure 4:
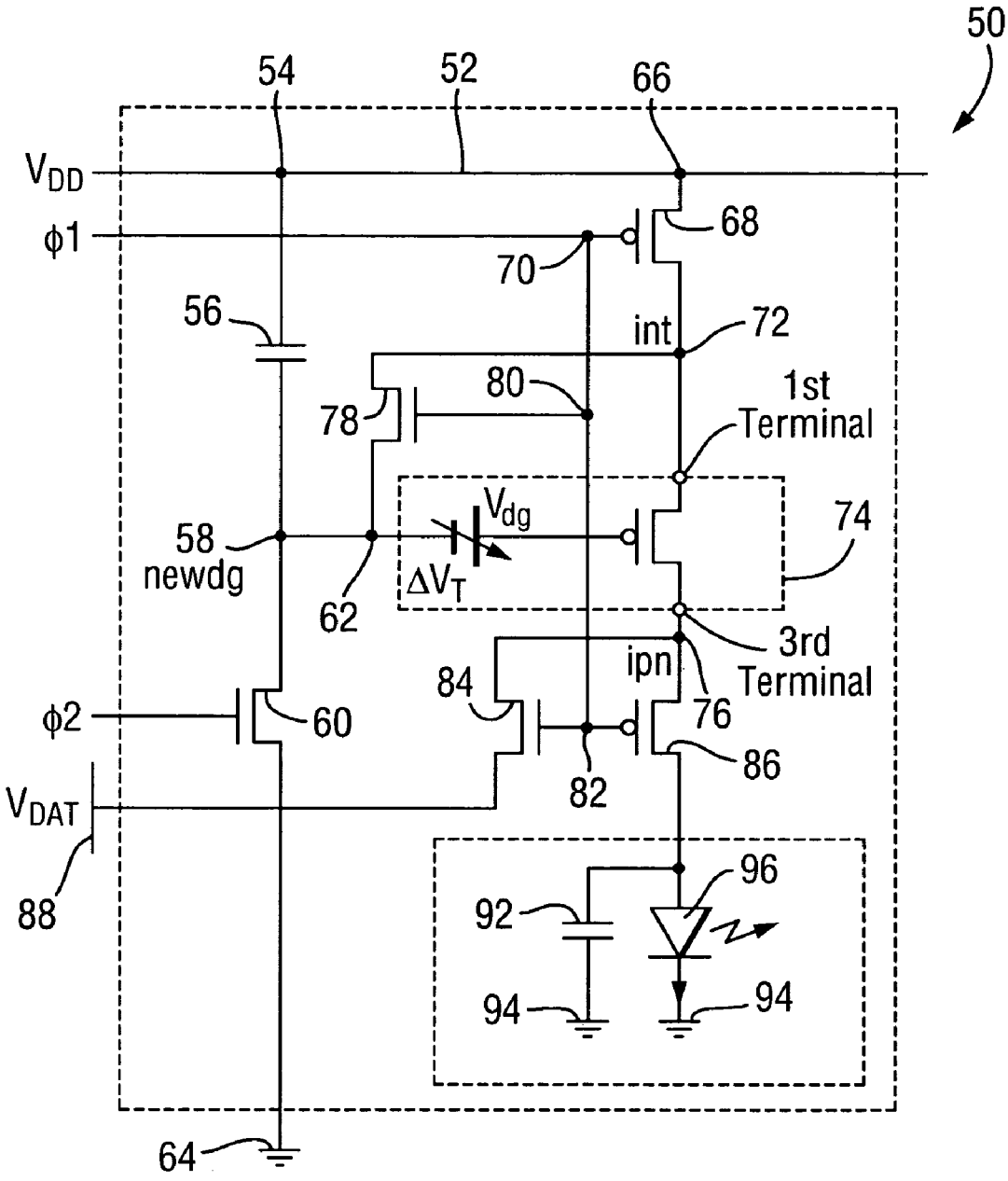
FIG. 4 is a schematic diagram of a pixel circuit according to a first embodiment of the present invention.

Referring to FIG. 4, a pixel circuit 50 according to a first embodiment of the present invention comprises a first rail 52 having a first node 54 coupled to a first terminal of a first capacitor 56. A second terminal of the first capacitor 56 is coupled to a second node 58 (referred to as newdg) which is coupled to a source terminal of a first n-channel transistor 60 and a third node 62. The first n-channel transistor 60 comprises a gate terminal and also a drain terminal that is coupled to a second rail 64.

The first rail 52 comprises a fourth node 66 coupled to a source terminal of a first p-channel transistor 68 comprising a gate terminal coupled to a fifth node 70 and a drain terminal coupled to a sixth node 72 (referred to as int). The sixth node 72 int is coupled to a first terminal of the driver transistor 74 comprising a gate terminal and a third terminal. The driver transistor 74 is a second p-channel transistor. As best seen with reference to FIG. 3 and also described in detail later with reference to FIG. 5, the first terminal and the third terminal of the driver transistor 74 can interchange as a source and a drain terminal depending upon whether the driver transistor 74 is diode-connected. The third terminal of the driver transistor 74 is coupled to a seventh node 76 (referred to as ipn) and the gate terminal is coupled to the third node 62.

The sixth node 72 int is also coupled to a source terminal of a second n-channel transistor 78 comprising a gate terminal coupled to an eighth node 80 and a drain terminal coupled to the third node 62. The eighth node 80 is coupled to an ninth node 82 which is coupled to a gate terminal of a third n-channel transistor 84 and to a gate terminal of a third p-channel transistor 86. A drain terminal of the third n-channel transistor 84 is coupled to the seventh node 76 ipn and a source terminal is coupled to a third rail 88. A source terminal of the third p-channel transistor 86 is coupled to the seventh node 76 ipn and a drain terminal is coupled to an anode terminal of an OLED 96 comprising a cathode terminal coupled to the fourth rail 94. A second capacitor 92 is also included in the pixel circuit 50 to represent an associated parasitic capacitance of the OLED 96.

With reference to the description above and throughout the following description, a reference to a node in the pixel circuit 50 is descriptive only. As an example, nodes 70, 80, and 82 of FIG. 4 can, alternatively, be illustrated as one connection.

In operation, a voltage $V_{DD}$ for example of 5V is applied across the pixel circuit 50 to drive the OLED 96, although other voltages can be used. As discussed above with reference to FIG. 3, the driver transistor 74 has a nominal threshold voltage $V_T$ and a threshold voltage variation $\Delta V_T$. The observed threshold voltage of the driver transistor 74 when diode connected is therefore $V_T+\Delta V_T$. The threshold voltage variation $\Delta V_T$ is represented in FIG. 4 and those following by a variable voltage source connected in series with the gate terminal of the driver transistor 74. The first n-channel transistor 60, second n-channel transistor 78 and third n-channel transistor 84 together with the first p-channel transistor 68 and third p-channel transistor 86 operate as switches under the control of a first signal $\phi$1 and a second signal $\phi$2 whilst the second p-channel transistor is the driver transistor 74 for supplying a controlled level of current to the OLED 96.

The pixel circuit 50 has three stages of operation: a pre-charge stage, a self-adjustment stage and an output stage.

In the pre-charge stage, the first signal $\phi$1 is logic 1 and is applied to the gate terminal of the second n-channel transistor 78, the third n-channel transistor 84, the first p-channel transistor 68 and the third p-channel transistor 86. The second n-channel transistor 78 and the third n-channel transistor are therefore switched on whilst the first p-channel transistor 68 and the third p-channel transistor 86 are switched off. Also in the pre-charge stage, the second signal $\phi$2 is logic 1 and is applied to the gate terminal of the first n-channel transistor 60 thereby switching on the first n-channel transistor 60. The driver transistor 74 is therefore diode-connected using the second n-channel transistor 78, isolated from the $V_{DD}$ to ground path by the switching off of the first p-channel transistor 68 and the second node 58 newdg is earthed through the switching on of the first n-channel transistor 60.

The third rail 88 is at a voltage $V_{DAT}$ that in the pre-charge stage of the present embodiment is, for example, 0V although other voltages can be used. Consequently, the second node 58, newdg, is pre-charged to a voltage Vnewdg equal to that of the second rail 64 such as ground (0V) and the pixel circuit 50 can be represented by the pixel circuit 50 illustrated in FIG. 5(*a*). As such, the voltage across the first capacitor 56 which is given by $V_{DD}$−Vnewdg=5V.

The second node 58 newdg and the sixth node 72 int are connected through the second n-channel transistor 78 and the voltage across the second node 58 Vnewdg equals the voltage across the sixth node 72 Vint. The supply rail 88 that supplies the voltage $V_{DAT}$ is connected to the seventh node 76 ipn through the third n-channel transistor 84 and the voltage across the seventh node 76 Vipn equals $V_{DAT}$. As such, the second node 58 newdg is the cathode terminal and the seventh node 76 ipn is the anode terminal of the diode-connected driver transistor 74.

In the self-adjustment stage, and more particularly during data transfer of the self-adjustment stage, the first signal ϕ1 remains logic 1 applied to the gate terminal of the second n-channel transistor 78, the third n-channel transistor 84, the first p-channel transistor 68 and the third p-channel transistor 86. The second n-channel transistor 78 and the third n-channel transistor remain switched on whilst the first p-channel transistor 68 and the third p-channel transistor 86 remain switched off.

The second signal ϕ2 becomes logic 0 applied to the gate terminal of the first n-channel transistor 60 thereby switching off the first n-channel transistor 60 causing the second node, newdg to no longer be earthed.

Voltage $V_{DAT}$ now pulses to a required value of $V_{DAT}$ for driving the OLED 96, for example 3V. Preferably, the commencement of the pulse to the required value of $V_{DAT}$ occurs simultaneously or later than the switching off of the first n-channel transistor 60.

Since the second node 58, newdg, is pre-charged to ground (0V) and is less than $V_{DAT}$ (3V), the diode-connected driver transistor 74 is forward-biased and current, I, flows to the first capacitor 56 to discharge the first capacitor 56 until a steady state is reached.

At steady state, $Vnewdg=V_{DAT}-(V_T+\Delta V_T)$. The voltage across the first capacitor 56 is therefore: $V_{DD}-Vnewdg=V_{DD}-(V_{DAT}-(V_T+\Delta V_T))$. If a value of 1.1V is provided for the nominal threshold voltage $V_T$, the voltage across the first capacitor 56 at steady state equals $3.1V+\Delta V_T$. The time taken for steady state to be reached is primarily dependent upon the RC time constant generated between the first capacitor 56 and the impedance of the second n-channel transistor 78 that enables the driving transistor 74 to be diode-connected. Although less significant, the resistance of the driver transistor 74 and the third n-channel transistor 84 also contribute to the time taken for steady state to be reached.

The effective voltage of the gate terminal, $Vdg=Vnewdg+\Delta V_T$. Therefore, when steady state is reached, the effective voltage of the gate terminal Vdg can be written as $Vdg=V_{DAT}-V_T=1.9V$ which is independent of any threshold variation $\Delta V_T$.

In the output stage, the first signal ϕ1 is logic 0 and is applied to the gate terminal of the second n-channel transistor 78, the third n-channel transistor 84, the first p-channel transistor 68 and the third p-channel transistor 86. The second n-channel transistor 78 and the third n-channel transistor are therefore switched off whilst the first p-channel transistor 68 and the third p-channel transistor 86 are switched on. In the output stage, the second signal ϕ2 remains logic 0.

Figure 5A:
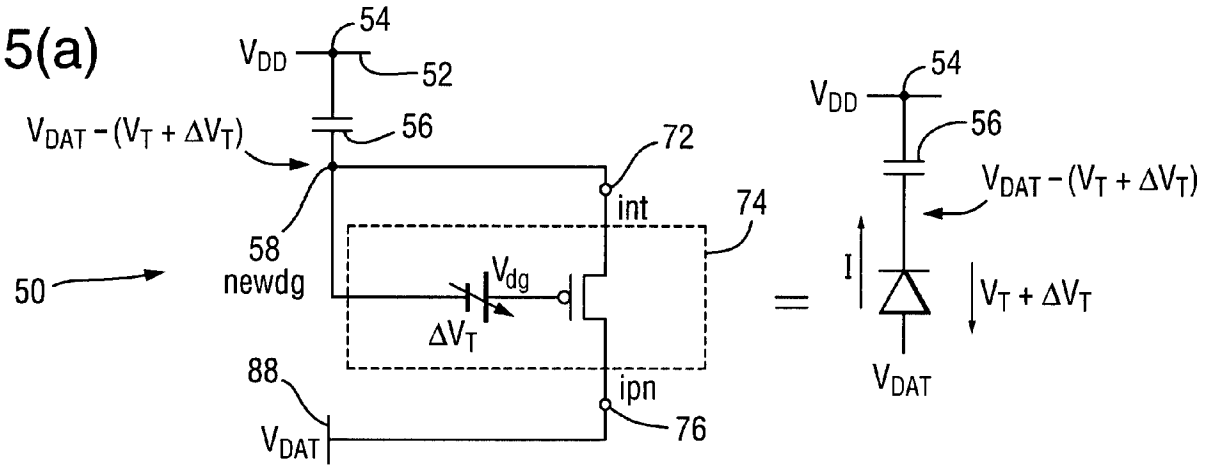
FIG. 5 is a schematic diagram illustrating a section of the pixel circuit of FIG. 4 at a steady state voltage.
Figure 5B:
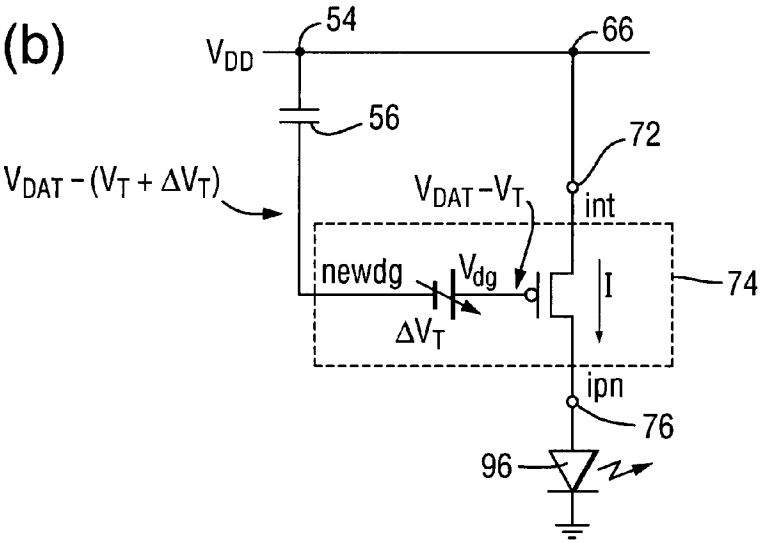

As best shown in FIG. 5(*b*), in the output stage, the driver transistor 74 is no longer diode-connected between the first terminal and the gate terminal and therefore acts as a constant current source for the OLED 96. The amplitude of the current passed to the OLED 96 by the driver transistor 74 is dependent on the value of $V_{DAT}$ (more specifically, the value that $V_{DAT}$ pulses to in the self-adjustment stage) and not the threshold variation $\Delta V_T$. Therefore, all pixel circuits 50 in an array forming a display are driven to the same brightness for the same value of $V_{DAT}$.

Exemplary driving waveforms for the pixel circuit 50 as illustrated in FIG. 4 are illustrated in FIG. 10. Referring to FIG. 10(*a*), the first signal ϕ1 and the second signal ϕ2 are both logic 1 indicating the commencement of the pre-charge stage in order to set the second node 58 newdg to a voltage equal to ground as described above. As the second signal ϕ2 drops to logic 0, the self-adjustment stage commences and $V_{DAT}$ pulses to a value of e.g., 3V. Since, the second node 58, newdg, is pre-charged to a voltage equal to that of ground and is less than $V_{DAT}$ (3V), the diode-connected driver transistor 74 is forward-biased and current, I, flows to the first capacitor 56 to discharge the first capacitor 56 until a steady state is reached. On reaching a steady state, the first signal ϕ1 becomes logic 0 and the output stage commences so as to drive the OLED 96 independently of threshold variation $\Delta V_T$. As should be appreciated by a person skilled in the art, the driving waveforms illustrated in FIGS. 10(*b*) to (*d*) are also equally applicable for use with the pixel circuit 50 described above.

In common with the arrangements discussed below, the arrangement shown in FIG. 4 has the advantages that the time taken for initialisation and programming of the pixel circuit is significantly reduced compared with prior art arrangements, thereby providing a more efficient, faster and more versatile display system. Moreover, the size of an individual pixel circuit is reduced in the present invention, thereby providing a more compact and efficient display with an improved aperture ratio.

In an alternative embodiment to the pixel circuit 50 of FIG. 4, the first n-channel transistor 60 is coupled to a supply line $V_{SS}$ instead of the second rail 64. The cathode terminal of the OLED 96 can also or instead be coupled to the supply line $V_{SS}$ rather than to the fourth rail 94.

Figure 6:
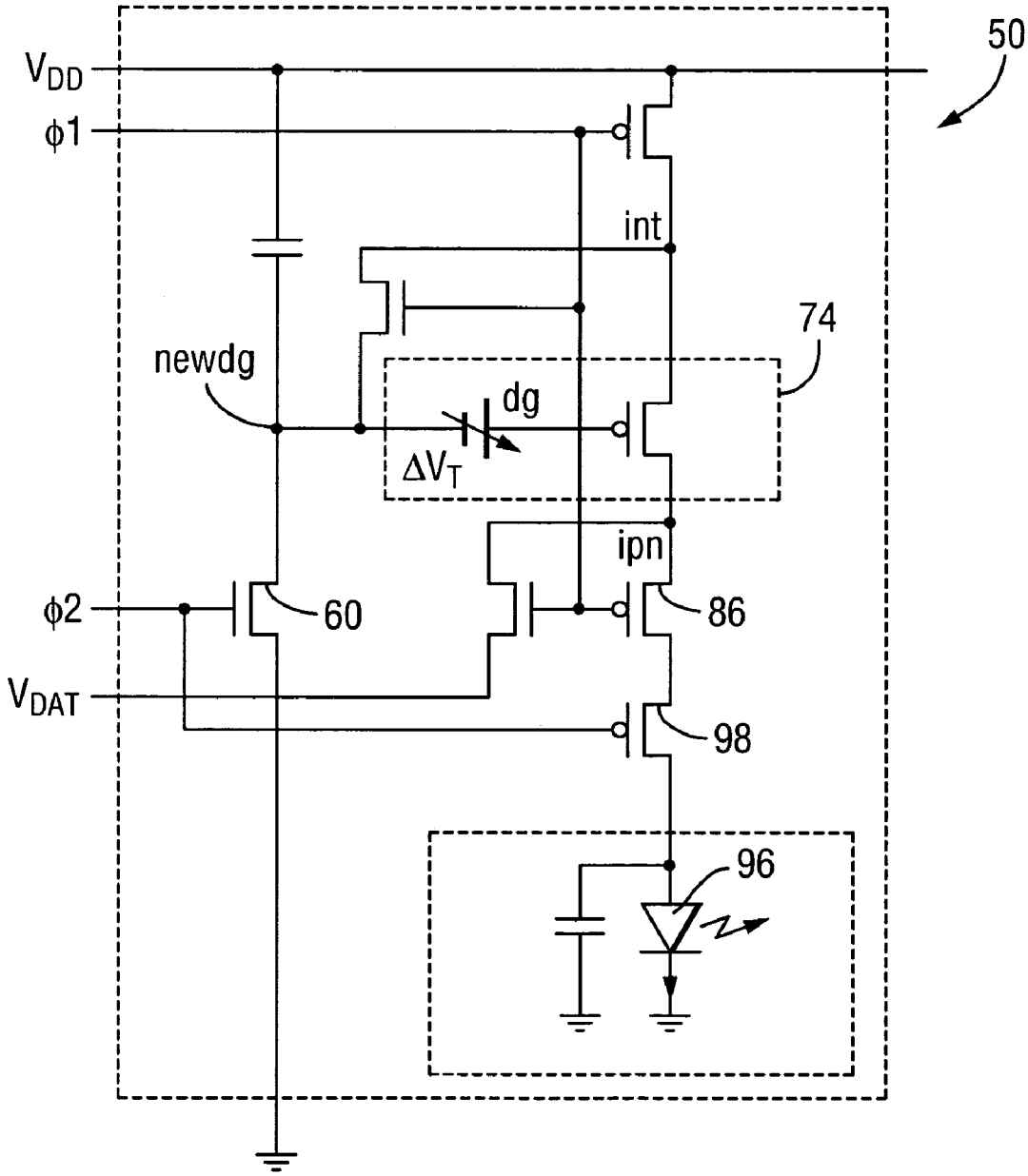
FIG. 6 is a schematic diagram of a pixel circuit according to a second embodiment of the present invention.

Referring to FIG. 6, the pixel circuit 50 of FIG. 4 according to a second embodiment of the present invention comprises an additional fourth p-channel transistor 98 comprising a source terminal coupled to the drain terminal of the third p-channel transistor 86 and a drain terminal coupled to the anode terminal of the OLED 96.

In operation, in the pre-charge stage, the second signal ϕ2 is applied to a gate terminal of the fourth p-channel transistor 98. The first n-channel transistor 60 is switched on and the fourth p-channel transistor 98 is switched off thereby isolating the OLED 96 during the pre-charge stage even if the first signal ϕ1 is logic 0 when the second signal ϕ2 is logic 1. The second embodiment therefore allows different driving waveforms to be used as described below with reference to FIGS. 11(*a*) and 11(*b*).

Referring to FIGS. 11(*a*) and (*b*), the second signal ϕ2 is logic 1 prior to the first signal ϕ1 becoming logic 1. If these driving waveforms were to be used in the circuit of FIG. 4, then when the second signal ϕ2 is logic 1 node newdg 58 is earthed and the gate voltage of the p-type driving transistor is earthed as well. Thus, the driving transistor 74 may be briefly switched on before the first signal ϕ1 is logic 1 and transistors 68 and 86 are switched off. At that time, the OLED 96 would be briefly driven to the maximum brightness. However, in the pixel circuit of FIG. 6 this does not matter since switch 98 is switched off when switch 60 is switched on and the OLED 96 is isolated, as discussed above.

Figure 7:
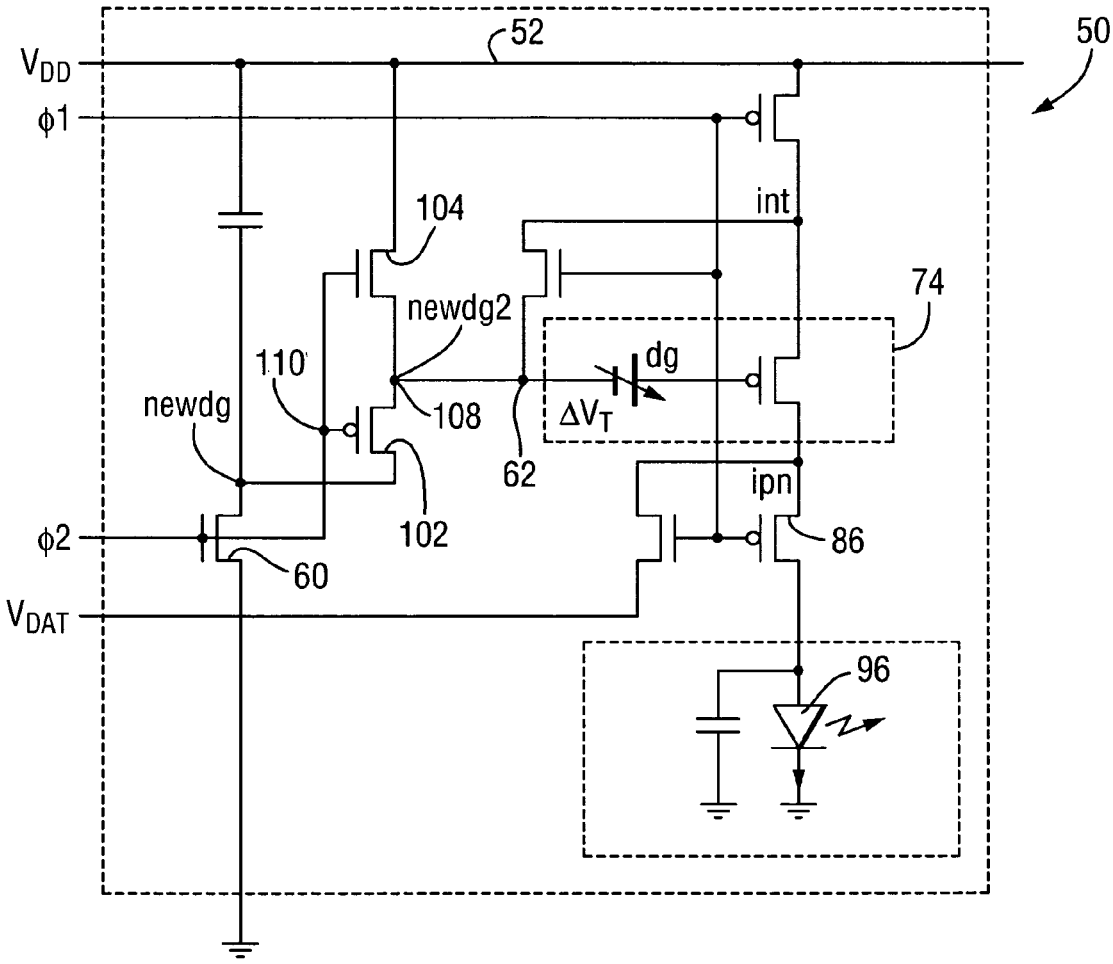
FIG. 7 is a schematic diagram of a pixel circuit according to a third embodiment of the present invention.

Referring to FIG. 7, the pixel circuit 50 of FIG. 4 according to a third embodiment of the present invention comprises an additional fifth p-channel transistor 102 and an additional fourth n-channel transistor 104. The fourth n-channel transistor 104 comprises a source terminal coupled to the first rail 52 and a drain terminal coupled to a node 108 referred to as newdg2. The node newdg2 is coupled to the third node 62—that is, node newdg2 and the third node 62 are technically the same—and to a first terminal of the fifth p-channel transistor 102. The fifth p-channel transistor 102 comprises a second terminal coupled to the second node 58 (newdg).

In operation, in the pre-charge stage, the second signal ϕ2 is applied to a gate terminal of the fourth n-channel transistor 104 and a gate terminal of the fifth p-channel transistor 102. When the second signal ϕ2 is logic 1 and the first n-channel transistor 60 is switched on, the fifth p-channel transistor 102 is switched off and the fourth n-channel transistor 104 is switched on thereby ensuring that the driver transistor 74 is also off in order to isolate the OLED 96.

Driving waveforms described above and below with reference to FIGS. 11(*a*) and 11(*b*) can also be used with the pixel circuit 50 shown in FIG. 7. More specifically, in FIG. 7 node newdg2 108 is held at $V_{DD}$ all the time that node newdg 58 is earthed, so the gate voltage of the driving transistor equals $V_{DD}$ and the driving transistor is not switched on. Accordingly, there is no need for transistor 98 provided in FIG. 6.

In an alternative to the arrangement shown in FIG. 7, transistor 104 can be changed from an n-channel transistor to a p-channel transistor and transistor 102 can be changed from a p-channel transistor to an n-channel transistor. This is beneficial for drawing current from the power supply $V_{DD}$. However, with the gates of both of the thus altered transistors connected to the second signal ϕ2, the two transistors act as an inverter. If only this change were to be made, the resultant inverter would output the inverted second signal ϕ2 bar at node newdg2. Thus, at the same time ϕ2 is high so that transistor 60 is switched on and node newdg is earthed, the inverter formed by transistors 104, 102 would output the inverted ϕ2bar (in other words a low) at newdg2. In that circumstance, the p-type driving transistor would be switched on and the OLED would emit before ϕ1 goes high and before the driving transistor is diode connected.

To counter this, a further inverter is added between the second signal line and the inverter formed by altered transistors 104, 102. Accordingly, the signal input to the inverter formed by altered transistors 104, 102 is ϕ2 bar. Thus, at the same time ϕ2 is high so that transistor 60 is switched on and node newdg is earthed, the inverter formed by transistors 104, 102 has ϕ2 bar as an input and outputs the ϕ2 (in other words a high) at newdg2. Consequently, the p-type driving transistor is switched off so the OLED 96 does not emit before ϕ1 goes high and before the driving transistor is diode connected.

Figure 8:
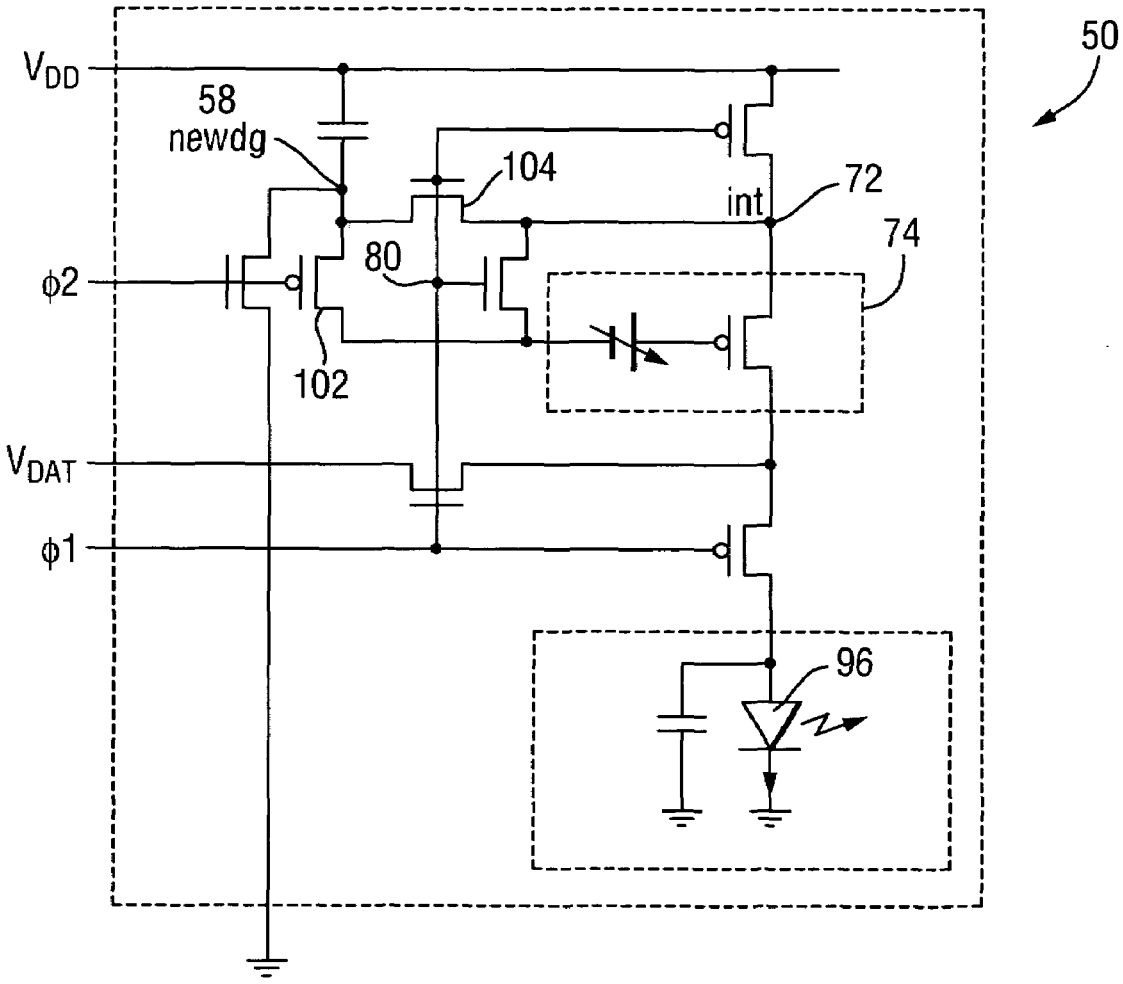
FIG. 8 is a schematic diagram of a pixel circuit according to a fourth embodiment of the present invention.

Referring to FIG. 8, a fourth embodiment of the present invention comprises the pixel circuit 50 of FIG. 7 with the fourth n-channel transistor 104 in an alternative configuration. The fourth n-channel transistor 104 comprises a terminal coupled to the sixth node 72 int and a terminal coupled to the second node newdg. The fourth n-channel transistor 104 comprises a gate terminal coupled to the eighth node 80 for receiving the first signal ϕ1.

In operation and when the first signal ϕ1 is logic 1 during the pre-charge stage and the self-adjustment stage, the fourth n-channel transistor 104 is switched on in order to improve the conductive path between the seventh node ipn and the second node newdg.

Figure 9:
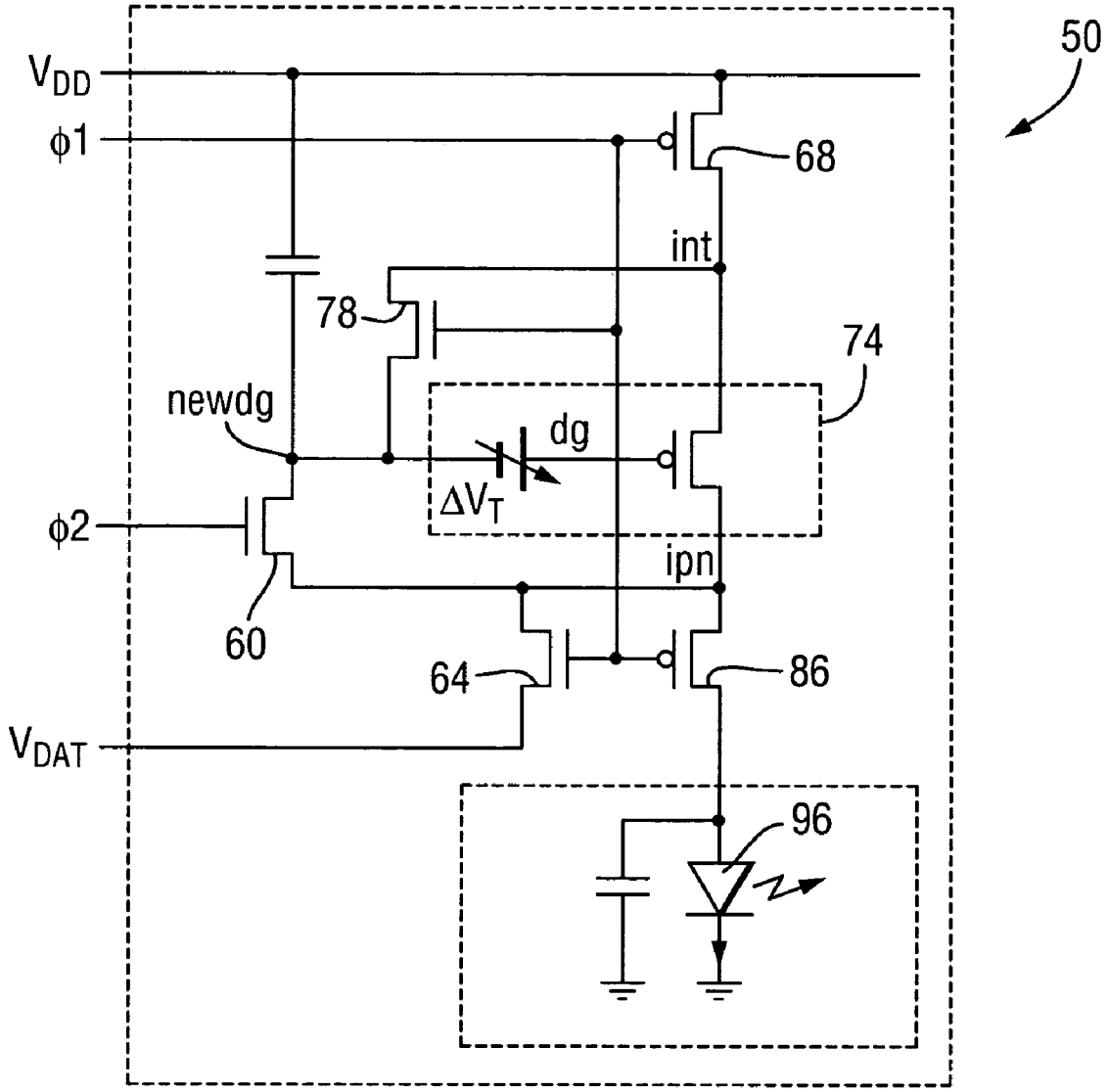
FIG. 9 is a schematic diagram of a pixel circuit according to a fifth embodiment of the present invention.
Figure 10A:
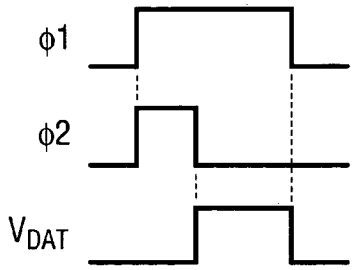
FIG. 10 is a schematic diagram of general driving waveforms for the pixel circuits as illustrated in FIGS. 4, 6, 7, 8 and 9.
Figure 10C:
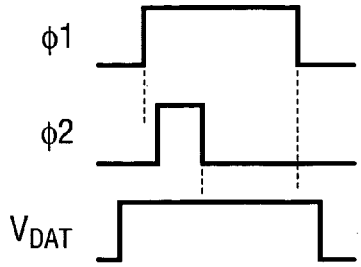
Figure 10B:
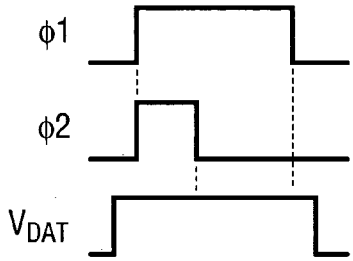
Figure 10D:
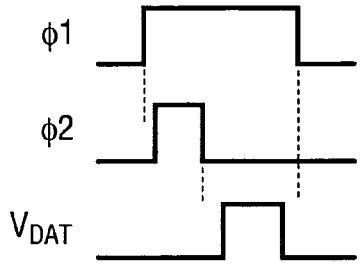
Figure 11A:
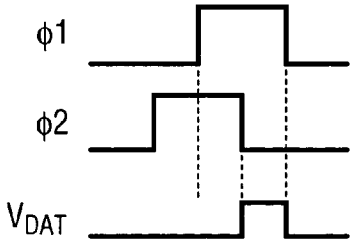
FIG. 11 is a schematic diagram of general driving waveforms for the pixel circuits as illustrated in FIGS. 6, 7, 8 and 9.
Figure 11C:
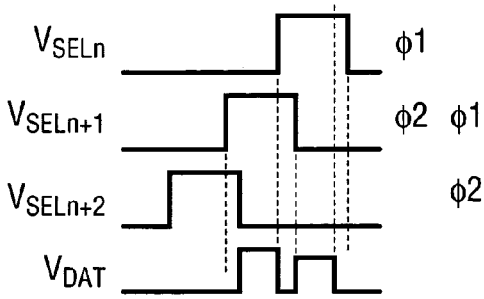
Figure 11B:
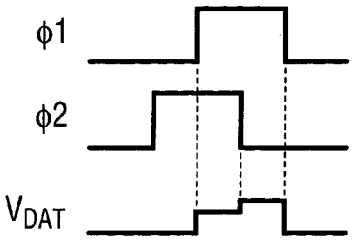
Figure 11D:
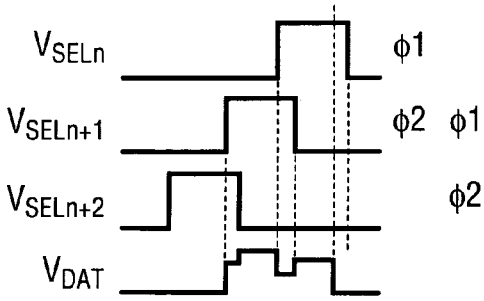

Referring to FIG. 9, the pixel circuit 50 of FIG. 4 according to a fifth embodiment of the present invention comprises a terminal of the first n-channel transistor 60 coupled to the seventh node ipn instead of being coupled to the second rail 64. Therefore, the driver transistor 74 is coupled to a terminal of the third p-channel transistor 86 and a terminal of the third n-channel transistor 84.

In operation, the voltage $V_{DAT}$ provides a pre-charge stage voltage to the second node newdg through the first n-channel transistor 60 and the third n-channel resistor 84. Therefore the second rail 64 is no longer needed as ground (0V) nor as replaced by a supply line $V_{SS}$. During the pre-charge stage, the voltage $V_{DAT}$ must be less than the voltage that $V_{DAT}$ pulses to in the self-adjustment stage so that the driver transistor 74 can behave as a forward-biased diode-connected transistor.

Exemplary driving waveforms for the pixel circuit 50 as illustrated in FIG. 9 are illustrated in FIG. 11(*b*). In the pre-charge stage, when the first signal ϕ1 is logic 0 and the second signal ϕ2 becomes logic 1, node newdg initially discharges through the first n-channel transistor 60, the third p-channel transistor 86 and the OLED 96 to ground. The first signal ϕ1 becomes logic 1 and $V_{DAT}$ increases to a value $V_{DAT}$ low. As such, the driver transistor 74 becomes diode connected and the node newdg is initialised to the voltage $V_{DAT}$ low through the third n-channel transistor 84 and the first n-channel transistor 60, the driver transistor 74 and the second n-channel transistor 78.

As the second signal ϕ2 drops to logic 0, and in the self-adjustment stage, $V_{DAT}$ low increases to a value $V_{DAT}$ high. As such, the node newdg increases to a value $V_{DAT}$ high−($V_T$+$\Delta V_T$) through the third n-channel transistor 84, the driver transistor 74 and the second n-channel transistor 78.

At the output stage, the first signal ϕ1 is logic 0 and the driver transistor 74 is no longer diode-connected between the first terminal and the gate terminal. The driver transistor 74 therefore acts as a constant current source for the OLED 96 through the first p-channel transistor 68, the driver transistor 74 and the third p-channel transistor 86. The amplitude of the current passed to the OLED 96 by the driver transistor 74 is dependent on the value of $V_{DAT}$ (more specifically, the value of $V_{DAT}$ high in the self-adjustment stage) and not the threshold variation $\Delta V_T$. Therefore, all pixel circuits 50 in an array forming a display are driven to the same brightness.

In a further alternative, the transistor 98 shown in FIG. 6 can also be included in each of the arrangements shown in FIGS. 7 to 9. Thus, in each case the pixel circuit includes p-channel transistor 98 coupled in series between transistor 86 and the OLED 96. The control signal ϕ2 is applied to the gate of p-channel transistor 98 so that p-channel transistor 98 is switched off whilst n-channel transistor 60 is switched on.

Figure 12:
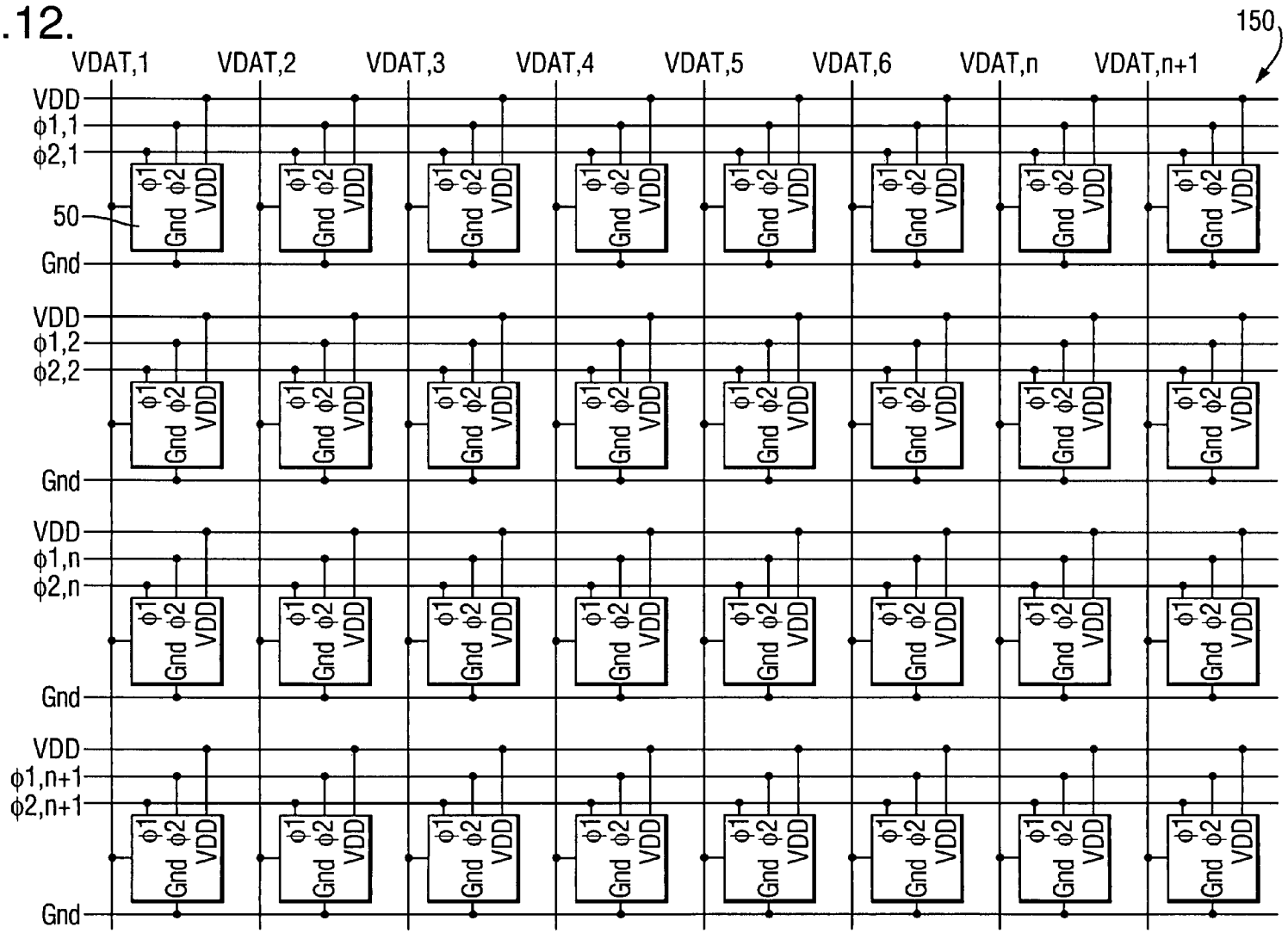
FIG. 12 is a schematic diagram of architecture for the pixel circuits as illustrated in FIGS. 4, 6, 7 and 8.

Referring to FIG. 12, an architecture for the pixel circuit 50 as illustrated in FIGS. 4, 6, 7, and 8 is shown in an array 150 forming a display system. The array 150 is driven by any one of the exemplary waveforms of FIG. 10 or FIG. 11(*a*). Each pixel circuit 50 of the array 150 comprises a ground line Gnd, which can be replaced by a supply line $V_{SS}$ as discussed above. The architecture also comprises two separate horizontal control lines to supply the first and second supply signals ϕ1 and ϕ2.

Figure 13:
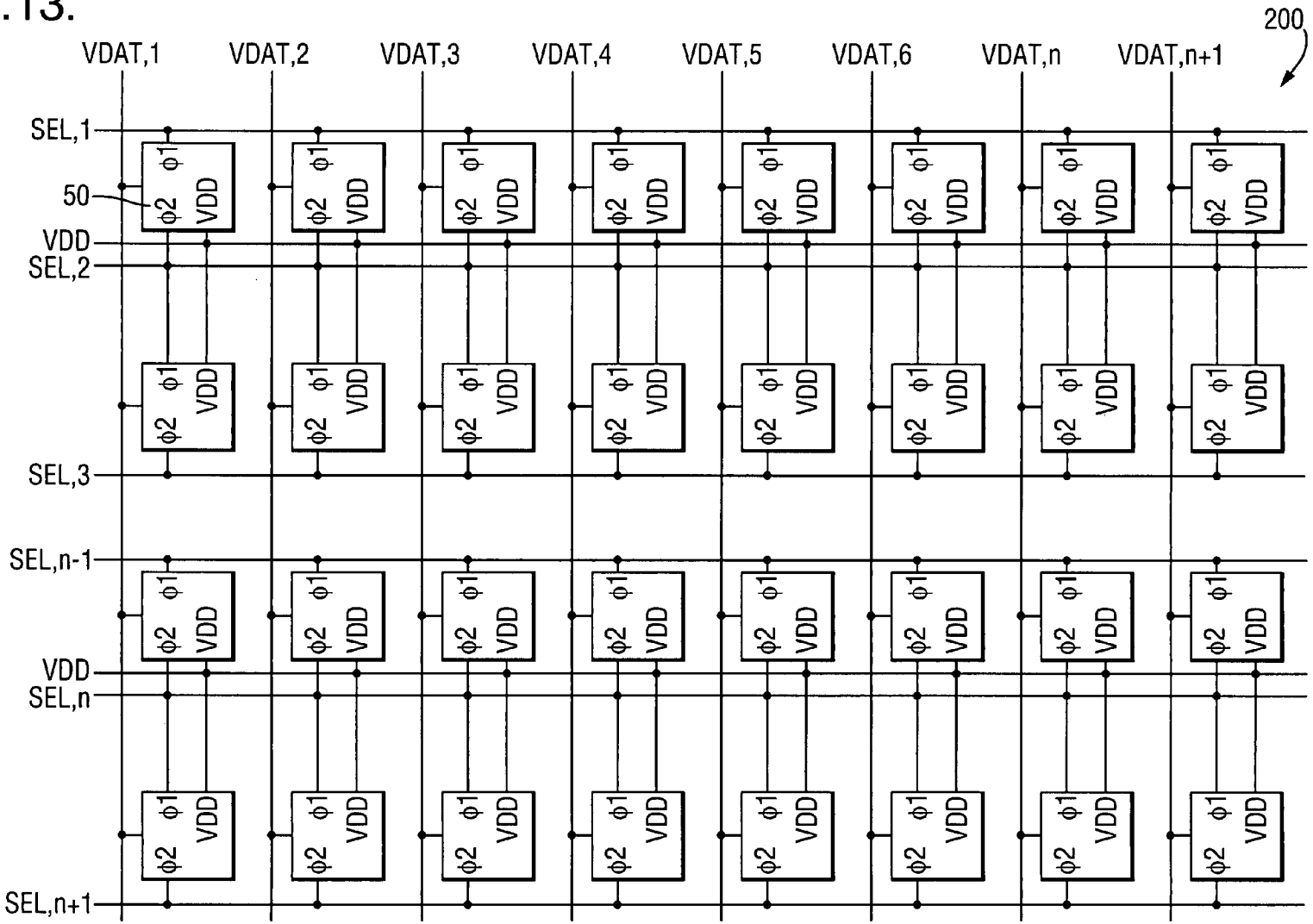
FIG. 13 is a schematic diagram of architecture for the pixel circuits as illustrated in FIG. 9.

Referring to FIG. 13, an architecture for the pixel circuit 50 as illustrated in FIG. 9 is shown in an array 200 forming a display system. By employing a waveform as illustrated in FIG. 11(*d*) in the case of the pixel circuit 50 as illustrated in FIG. 9 a reduction in the number of horizontal control lines is demonstrated when compared to the architecture of FIG. 12.

The reduction in the number of horizontal control lines is realised since the control line SEL,2 (referred to as a control signal $V_{SELn+1}$ in FIGS. 11(*c*) and (*d*)) provides both the first control signal ϕ1 and the second control signal ϕ2 for adjacent pixel circuits 50.

Of course, the architecture shown in FIG. 12, in which two signal lines are provided for each row of pixels, could be adjusted so that the capacitor in each pixel circuit discharges to a data line VDAT instead of to ground Gnd, similar to FIG. 13. By employing a waveform as illustrated in FIG. 11(*c*) in the case of the pixel circuit 50 as illustrated in FIGS. 6, 7 and 8 a reduction in the number of horizontal lines would be demonstrated when compared to the architecture of FIG. 12.

Similarly, the architecture shown in FIG. 13, in which signal lines are shared between adjacent rows of pixels, could be adjusted so that the capacitor in each pixel circuit discharges to ground Gnd instead of to a data line VDAT, similar to FIG. 12. By employing a waveform as illustrated in FIG. 11(*b*) in the case of the pixel circuit 50 as illustrated in FIG. 9 a reduction in the number of horizontal control lines would be demonstrated when compared to the architecture of FIG. 12.

Of course, the arrays in FIGS. 12 and 13 are also applicable to all suitable alternatives of the pixel circuits of the present invention, whether or not described above.

It is noted that in each of FIGS. 11(*a*) to (*d*) the first and second control signals $\phi$1 and $\phi$2 are overlapping. That is, $\phi$1 is high for a part of the time that $\phi$2 is high and $\phi$2 is high for a part of the time that $\phi$1 is high. However, $\phi$1 is also high for a part of the time that $\phi$2 is low and $\phi$2 is also high for a part of the time that $\phi$1 is low. This possibility of using overlapping control signals, which is hitherto unknown, allows increased scanning speeds and consequently improves the quality of displayed moving images.

Figure 14:
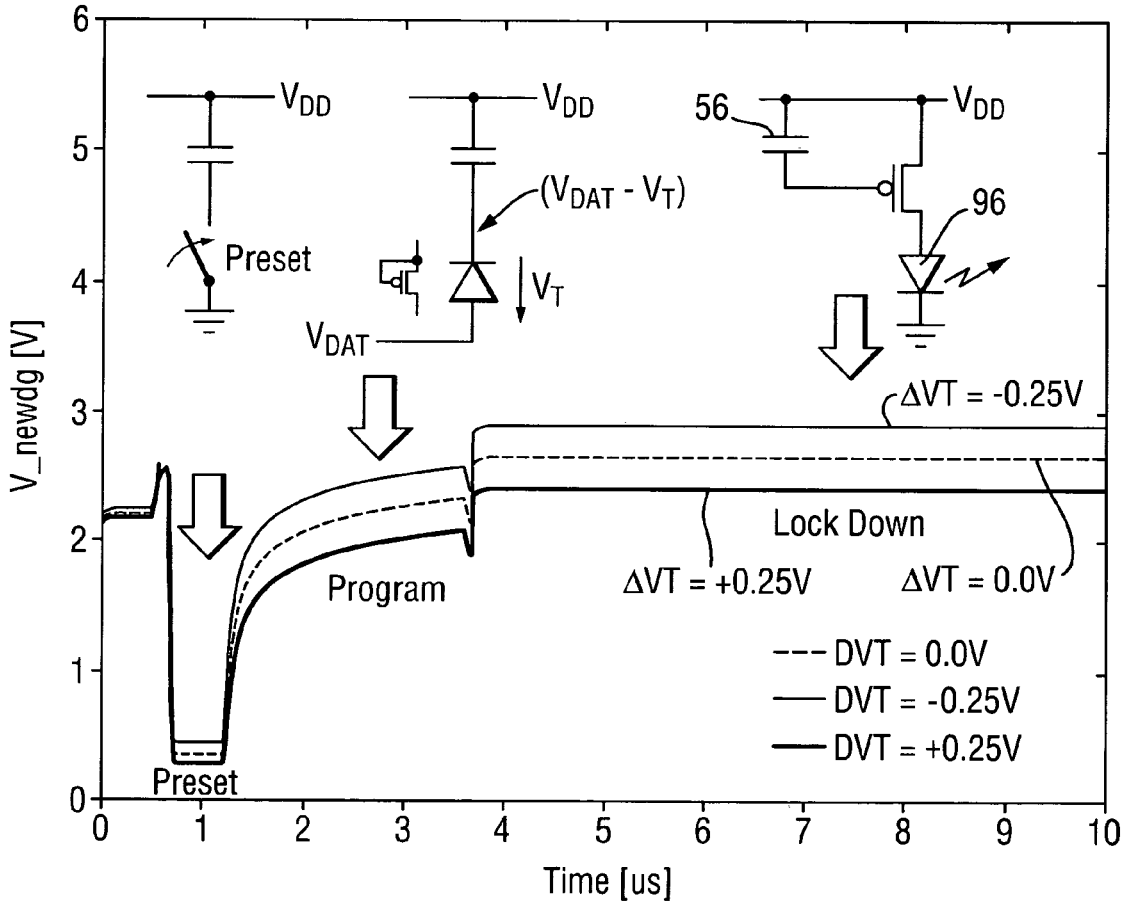
FIG. 14 is a schematic diagram of a simulation of a voltage at the node newdg for the pixel circuit as illustrated in FIG. 4.

Referring to FIG. 14, a simulation of the voltage Vnewdg at the second node 58 for the pixel circuit 50 as illustrated in FIG. 4 is shown graphically against time in microseconds. In the pre-charge stage (labeled as PRESET in FIG. 12) the voltage Vnewdg drops substantially to ground (0V). In the self-adjustment stage (labeled as PROGRAM) in FIG. 12 the voltage Vnewdg climbs to a value $V_{DAT}-(V_T+\Delta V_T)$ as $V_{DAT}$ pulses to a voltage for driving the OLED 96. In the output stage (referred to as LOCK DOWN) in FIG. 12, the voltage Vnewdg is maintained by the first capacitor 56 until the process is repeated. As can be readily appreciated from FIG. 12, the voltage Vnewdg varies with respect to varying values of $\Delta V_T$.

From FIG. 14 it can be seen that the pre-charge and self-adjustment stages can be completed in a matter of only a few microseconds. This is approximately two orders of magnitude (or 100 times) faster than that achieved in the prior art. In addition, lower voltages can be used. Accordingly, the present invention provides improved display quality and reduced power consumption. Moreover, a pixel circuit and a display device according to the present invention are smaller and more compact than those of the prior art.

Figure 15:
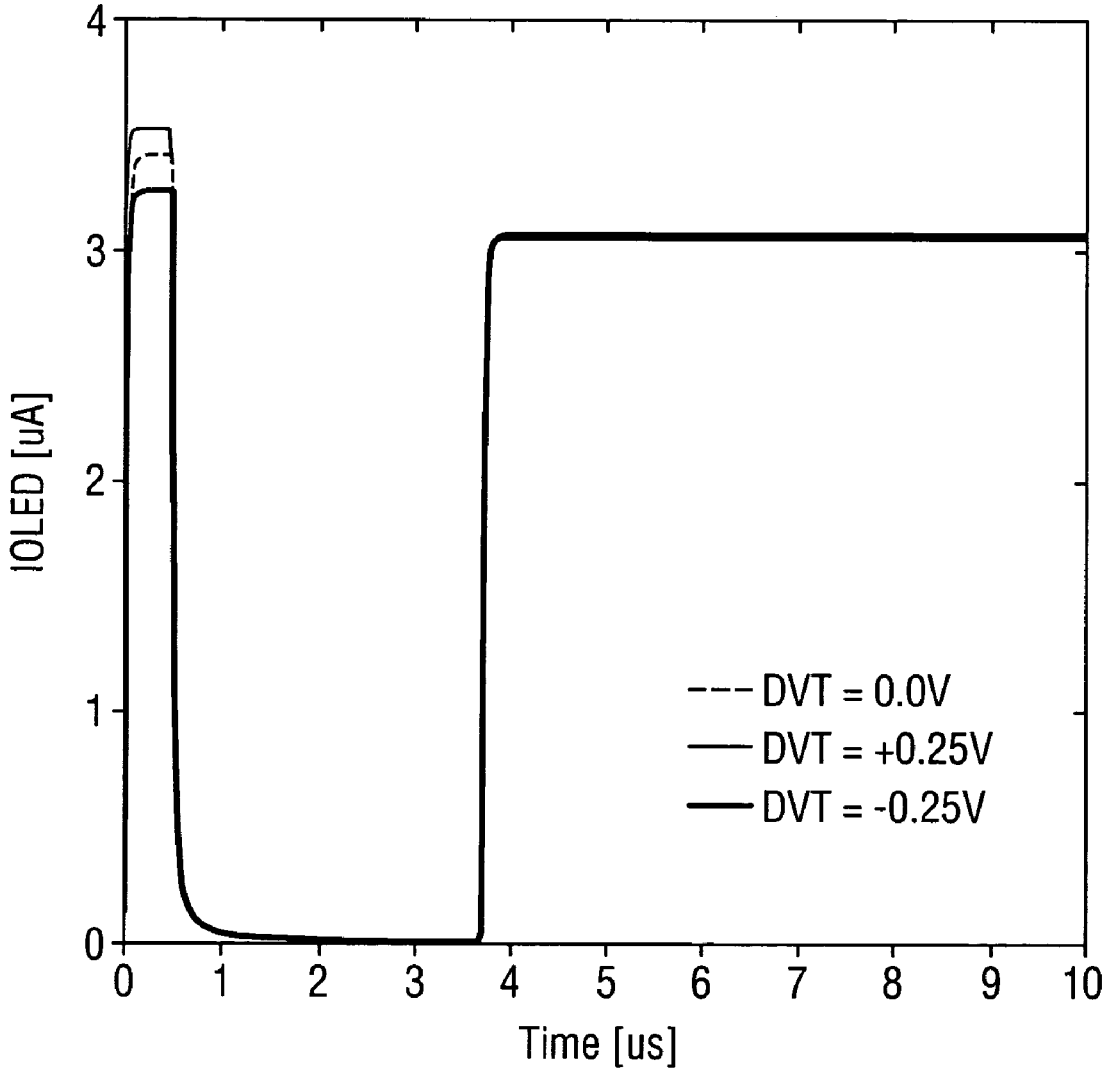
FIG. 15 is a schematic diagram of a simulation of an output current for varying values of $\Delta V_T$.

Referring to FIG. 15, a simulation of an output current (IOLED) for driving the OLED 96 is plotted against varying values of $\Delta V_T$. As such, FIG. 15 demonstrates that the output current IOLED is the same, irrespective of $\Delta V_T$, so the pixel circuits forming an array can be driven to the same brightness despite varying values of $\Delta V_T$.

Figure 16B:
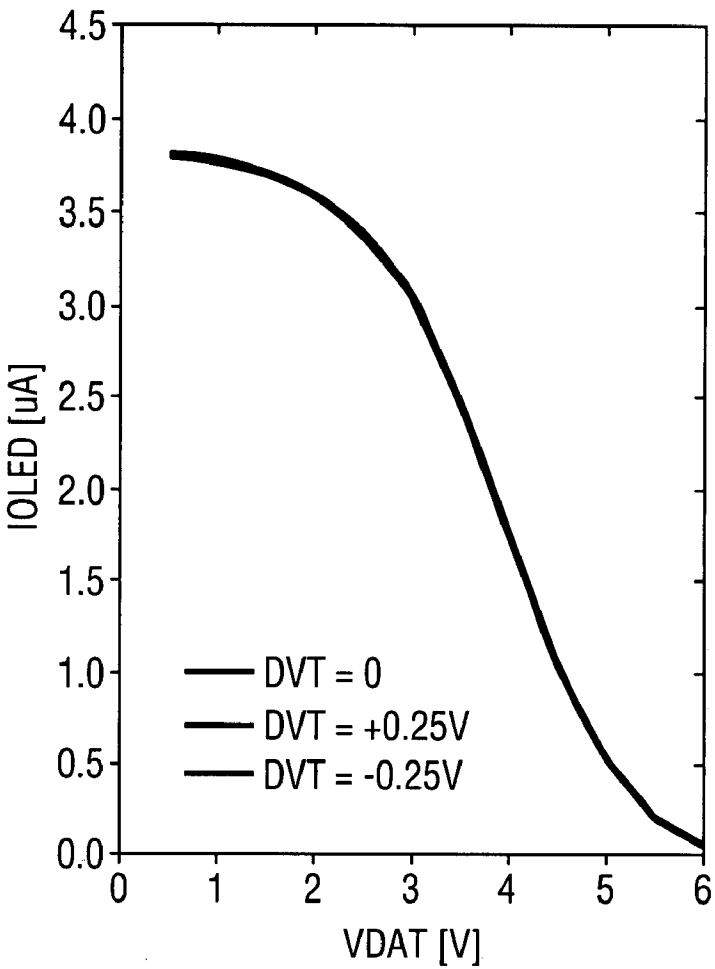
FIG. 16 is a schematic diagram of a simulation of an output current for different input voltages and for varying values of $\Delta V_T$.
Figure 16A:
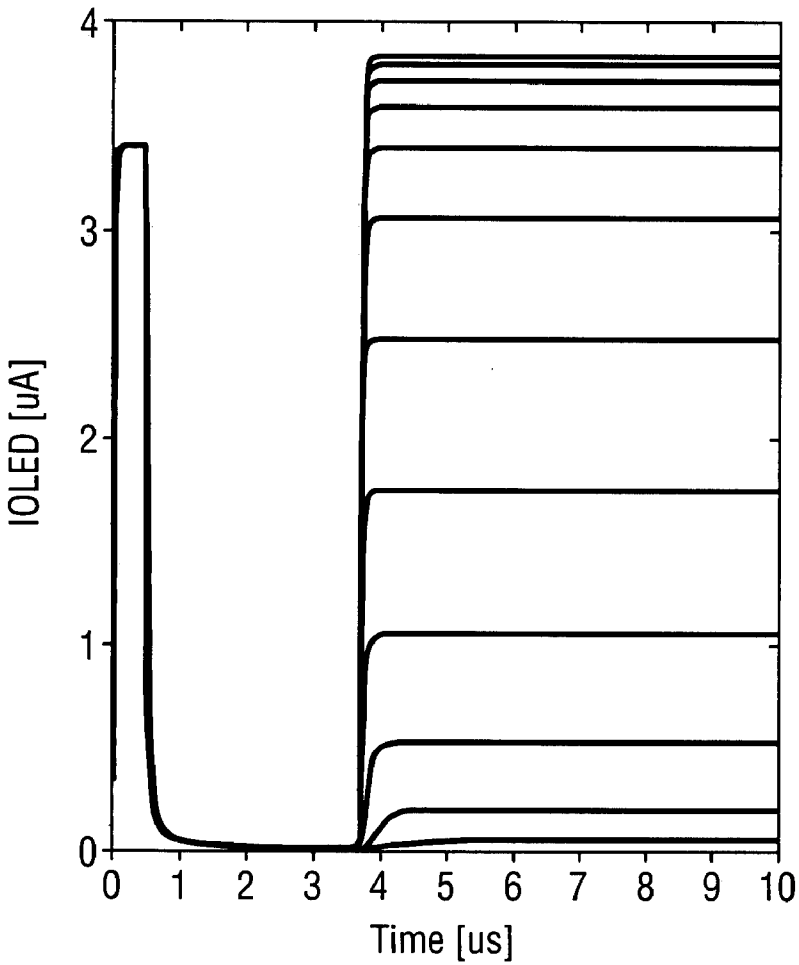

FIG. 16, illustrates a similar effect. In FIG. 16(*a*), the output current IOLED is plotted graphically against time in microseconds for varying values of input voltages, $V_{DD}$, which result in varying amplitudes of output current IOLED, and varying values of $\Delta V_T$, which do not affect output IOLED. FIG. 16(*b*) shows variation of IOLED with variation in $V_{DAT}$, for different $\Delta V_T$. The output current IOLED is substantially equal, irrespective of $\Delta V_T$, and therefore output currents IOLED for respective values of $\Delta V_T$ are superimposed. The pixel circuits forming an array can therefore be driven to the same brightness despite varying values of $\Delta V_T$.

A display system 1000 using the pixel circuit 50 as described above is advantageous for use in small, mobile electronic products such as mobile phones, personal digital assistants (PDA), computers, CD players, DVD players and the like—although it is not limited thereto.

Several terminal devices in which the display system 1000 can be embedded will now be described.

Figure 17:
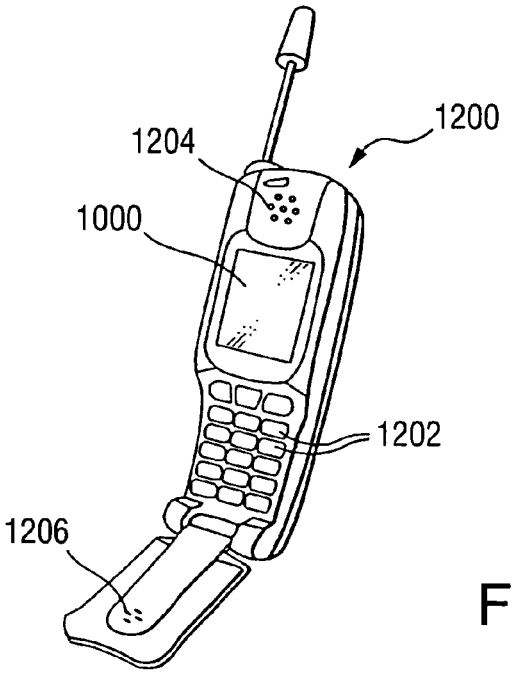
FIG. 17 is a schematic view of a mobile telephone incorporating a display system according to the present invention.

An example in which the display system 1000 is applied to a portable or mobile phone will be described. FIG. 17 is an isometric view illustrating the configuration of the portable phone. In the drawing, the portable phone 1200 is provided with a plurality of operation keys 1202, an earpiece 1204, a mouthpiece 1206, and the display system 1000 in the form of a display panel. The mouthpiece 1206 or earpiece 1204 may be used for outputting speech.

An example in which the display system 1000 according to one of the above embodiments is applied to a mobile personal computer will now be described.

Figure 18:
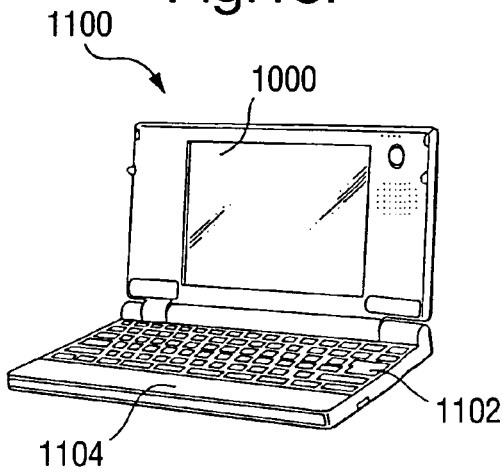
FIG. 18 is a schematic view of a mobile personal computer incorporating a display system according to the present invention.

FIG. 18 is an isometric view illustrating the configuration of this personal computer. In the drawing, the personal computer 1100 is provided with a body 1104 including a keyboard 1102 and the display system 1000 in the form of a display panel.

Figure 19:
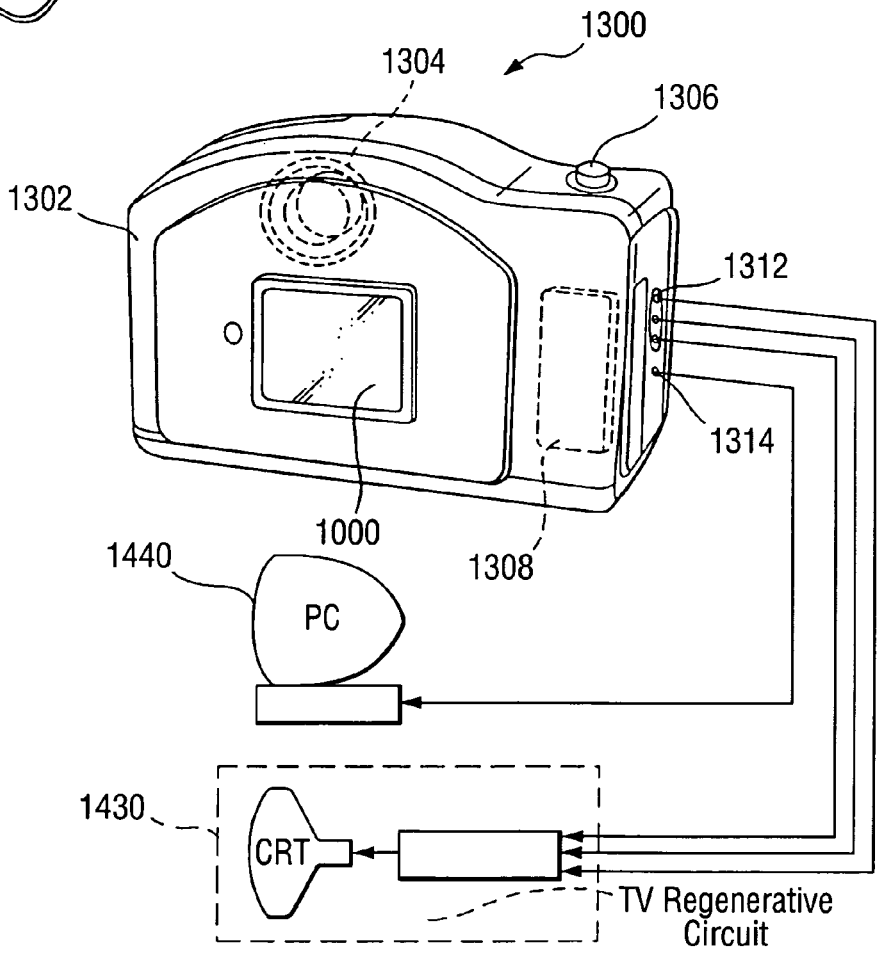
FIG. 19 is a schematic view of a digital camera incorporating a display system according to the present invention.

Next, a digital still camera using the display system 1000 will be described. FIG. 19 is an isometric view illustrating the configuration of the digital still camera and the connection to external devices in brief.

Typical cameras sensitise films based on optical images from objects, whereas the digital still camera 1300 generates imaging signals from the optical image of an object by photoelectric conversion using, for example, a charge coupled device (CCD). The digital still camera 1300 is provided with the display system 1000 in the form of a display panel at the back face of a case 1302 to perform display based on the imaging signals from the CCD. Thus, the display system 1000 functions as a finder for displaying the object. A photo acceptance unit 1304 including optical lenses and the CCD is provided at the front side (behind in the drawing) of the case 1302. The display system 1000 may be embodied in the digital still camera.

Further examples of terminal devices, other than the portable phone shown in FIG. 17, the personal computer shown in FIG. 18, and the digital still camera shown in FIG. 19, include a personal digital assistant (PDA), television sets, view-finder-type and monitoring-type video tape recorders, car navigation systems, pagers, electronic notebooks, portable calculators, word processors, workstations, TV telephones, point-of-sales system (POS) terminals, and devices provided with touch panels. Of course, the display system of the present invention can be applied to any of these terminal devices.

The aforegoing description has been given by way of example only and a person skilled in the art will appreciate that modifications can be made without departing from the scope of the present invention.

The invention claimed is:

1. A pixel circuit comprising:

a first transistor electrically connected to a power supply line, a gate of the first transistor being supplied with a first control signal, the first transistor being a first conductive type;

a second transistor electrically connected to a light emitting device, a gate of the second transistor being supplied with the first control signal, the second transistor being the first conductive type;

a drive transistor positioned between the first and second transistors, the drive transistor supplying a power to the light emitting device from the power supply line when the first transistor and the second transistor are turned on by a first level of the first control signal;

a third transistor electrically connected to a first node between the first transistor and the drive transistor, a gate of the third transistor being supplied with the first control signal, the third transistor being a second conductive type; and a fourth transistor electrically connected to a second node between the second transistor and the drive transistor, the fourth transistor electrically connected to a voltage supply line, a gate of the fourth transistor being supplied with the first control signal, the fourth transistor being the second conductive type, the drive transistor being set in a diode-connected state when the third transistor and the fourth transistor are turned on by a second level of the first control signal.

2. The pixel circuit according to claim 1, the pixel circuit further comprising:

a capacitor electrically connected to the power supply line and the third transistor; and a fifth transistor electrically connected to the capacitor and the third transistor, a gate of the fifth transistor being controlled by a second control signal.

3. The pixel circuit according to claim 2, the fifth transistor being the second conductive type.

4. The pixel circuit according to claim 1, the first conductive type being p-type and the second conductive type being n-type.

5. The pixel circuit according to claim 1, the drive transistor being configured to supply the power to the light emitting device after the drive transistor is set in the diode-connected state.

6. The pixel circuit according to claim 1, a first terminal of the drive transistor being electrically connected to a gate of the drive transistor and a second terminal of the drive transistor being electrically connected to the voltage supply line while the fourth transistor is turned on by the first control signal.

7. A pixel circuit comprising:

a first conductive type transistor electrically connected to a power supply line, a gate of the first conductive type transistor being supplied a first control signal;

a second conductive type transistor electrically connected to a voltage supply line, a gate of the second conductive type transistor being supplied the first control signal; and a drive transistor positioned between the first and second conductive type transistors, the drive transistor supplying a power to a light emitting device from the power supply line when the first conductive type transistor is turned on by a first level of the first control signal, and the drive transistor forming a diode-connected state when the second conductive type transistor is turned on by a second level of the first control signal.

8. The pixel circuit according to claim 7, a first terminal of the drive transistor being electrically connected to a gate of the drive transistor and a second terminal of the drive transistor being electrically connected to the voltage supply line while the second conductive type transistor is turned on by the first control signal.

9. A display apparatus, comprising:

a plurality of pixel circuits, each of the plurality of pixel circuits defined according to claim 7;

the power supply line supplying a power to at least one of the plurality of pixel circuits; and the voltage supply line supplying a voltage to at least one of the plurality of pixel circuits.

10. The display apparatus according to claim 9, further comprising:

a first selecting line supplying the first control signal to at least one of the plurality of pixel circuits; and a second selecting line supplying a second control signal to at least one of the plurality of pixel circuits.

* * * * *